US006019434A

United States Patent [19]

Emmerich

[11] Patent Number: 6,019,434

[45] Date of Patent: Feb. 1, 2000

[54] POINT ATTACK BIT

[75] Inventor: Kenneth C. Emmerich, Lexington, Ky.

[73] Assignee: Fansteel Inc., North Chicago, Ill.

[21] Appl. No.: 08/946,023

[22] Filed: Oct. 7, 1997

[51] Int. Cl.[7] ..... E21C 35/18

[52] U.S. Cl. ..... 299/111

[58] Field of Search ..... 299/110, 111, 299/101

[56] References Cited

U.S. PATENT DOCUMENTS

| | | | |
|---|---|---|---|
| 3,268,260 | 8/1966 | Snipe . | |
| 3,476,438 | 11/1969 | Bower | 299/111 |
| 3,833,264 | 9/1974 | Elders | 299/86 |
| 4,729,603 | 3/1988 | Elfgen . | |
| 4,938,538 | 7/1990 | Larsson et al. . | |
| 5,131,725 | 7/1992 | Rowlett et al. | 299/111 |
| 5,161,859 | 11/1992 | Larsson et al. . | |
| 5,324,098 | 6/1994 | Massa et al. . | |
| 5,551,760 | 9/1996 | Sollami | 299/105 |

FOREIGN PATENT DOCUMENTS

| | | |
|---|---|---|
| 3607938 | 9/1987 | Germany . |
| 0870701 | 10/1981 | U.S.S.R. . |

OTHER PUBLICATIONS

The Tungsten & Carbide Link, vol. 4, No. 1, p. 5, Aug. 2, 1999, China Pacific Carbide, Yorba Linda, CA.

*Primary Examiner*—David Bagnell
*Assistant Examiner*—John Kreck
*Attorney, Agent, or Firm*—Reising, Ethington, Barnes, Kisselle, Learman & McCulloch, P.C.

[57] ABSTRACT

A point attack bit has an enlarged head, an integral and coaxial shank extending from the base of the head, and a tip extending from the other end of the head and having a generally frustoconical end with an odd number of side faces disposed between the end and the head. The odd number of side faces create an unbalanced loading on the bit when it engages the surface to be mined, excavated or cut and cause the bit to rotate within a mounting block in which the shank is rotatably received to reduce the wear on and more evenly wear the bit. The faces may be generally flat or they may be arcuate providing a generally frustoconical tip. The tip is preferably a carbide insert operably connected to the head of the bit. In one form, the head is frustoconically shaped and has a smooth exterior. In a second form, the head has a construction similar to that of the tip and preferably has the same number of side faces as the tip with each face of the head and tip generally aligned.

16 Claims, 3 Drawing Sheets

POINT ATTACK BIT

FIELD OF THE INVENTION

This invention relates generally to a machine tool bit and more particularly to a construction or mining type point attack bit.

BACKGROUND OF THE INVENTION

In the construction or mining industries, large machines carry wheels or chains with spaced mounting blocks which carry contact tools or mining bits. Each block has a cylindrical recess to receive the mounting shank of a bit and the cutting or tip portion of the bit projects from the block.

It is generally desirable to have these bits rotate in the blocks to reduce the wear on the bit and equalize the wear around the bit. Reducing the wear of the bit extends the life of the bit and thus, reduces the down time of the machines necessary to replace worn bits. Also, providing a bit which wears evenly provides a self-sharpening action which further extends the life of the bit and reduces the down time of the machines.

U.S. Pat. No. 3,833,264 discloses a mining bit which has a plurality of protuberances, or a straight or spiral fm, or a head having a plurality of flat faces with a complimentarily shaped tip. The protuberances, fms or side edges of the flat faces provide turning means serving to strike the surface contacted by the bit to rotate the bit within the mounting block. However, the protuberances, fins or three straight edged sides of the bit formed accordingly wear rather rapidly necessitating frequent replacement and hence, increased down time of the machine.

SUMMARY OF THE INVENTION

A point attack bit has an enlarged head, an integral and coaxial shank extending from the base of the head, and a tip extending from the other end of the head and having a generally frustoconical end with an odd number of at least five side faces disposed between the end and the head. The odd number of side faces create an unbalanced loading of the bit when it engages the surface to be mined or excavated and cause the bit to rotate within a mounting block in which the shank is rotatably received to reduce the wear on and more evenly wear the bit. The faces may be generally flat or they may be arcuate providing a generally frustoconical tip. The tip is preferably a carbide insert fixed to the head of the bit. In one form, the head is frustoconically shaped and has a smooth exterior. In a second form, the head has a construction similar to that of the tip and preferably has the same number of side faces as the tip with each face of the head and tip generally aligned.

The odd number of side faces in the tip provide an asymmetry which causes the bit to rotate as the bit engages the surface to be mined or excavated. Rotation of the bit exposes a different circumferential portion of the bit to the surface so that each of the faces are exposed to the surface throughout the life of the tip to reduce the wear on the tip and to more evenly wear each portion of the tip to extend the life of the tip. Providing uniform wear of the tip provides a self sharpening action which maintains the shape of a tip even as it wears which further increases the life of the tip in use.

Objects, features and advantages of this invention include providing a bit which automatically rotates in use to reduce wear of the bit, provides even wear of the bit, provides a self-sharpening bit, has a long life in use to reduce the down time of the associated machine, is reliable, durable, effective and of relatively simple design and economical manufacture.

BRIEF DESCRIPTION OF THE DRAWINGS

These and other objects, features and advantages of this invention will be apparent from the following detailed description of the preferred embodiments and best mode, appended claims and accompanying drawings in which:

DETAILED DESCRIPTION OF THE PREFERRED EMBODIMENTS

Figure 1:
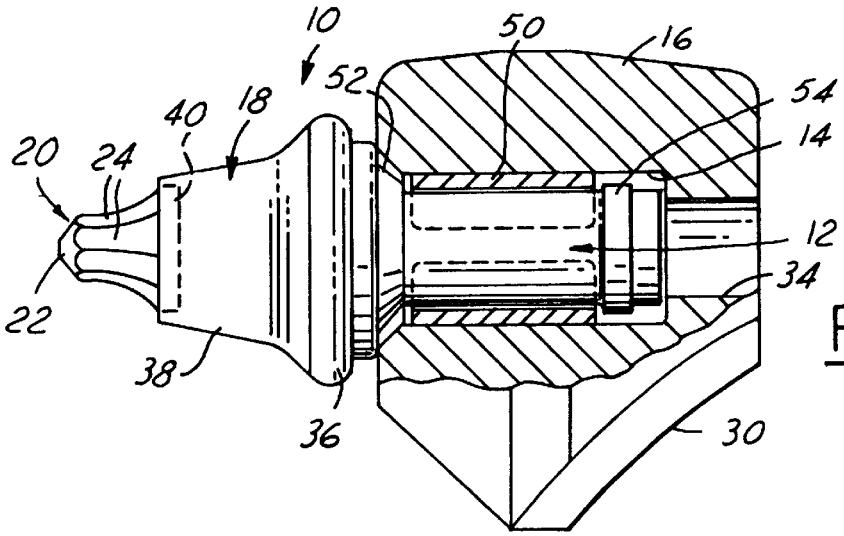
FIG. 1 is a partial cross sectional view of a bit embodying this invention received within a mounting block.
Figure 2:
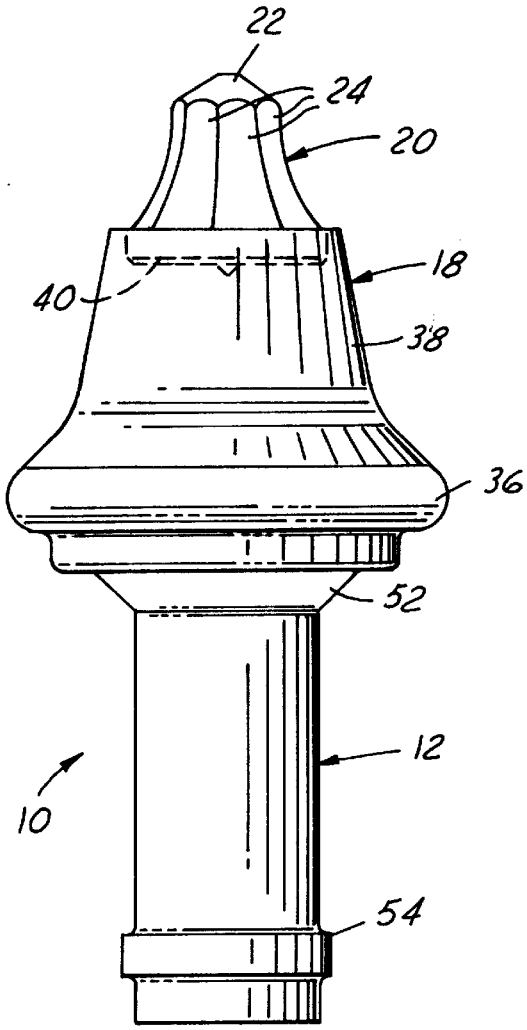
FIG. 2 is an enlarged side view of the bit of FIG. 1.
Figure 3:
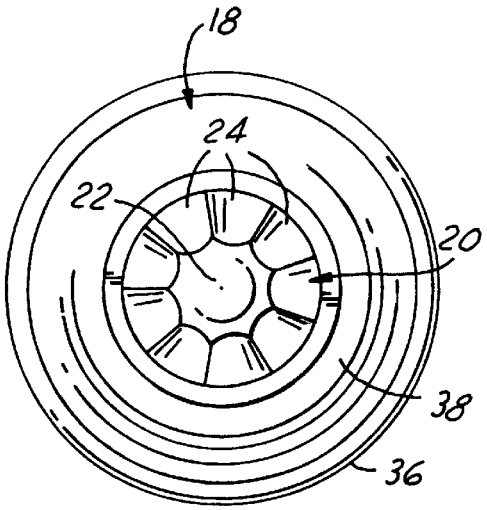
FIG. 3 is an end view of the bit of FIG. 1.
Figure 4:
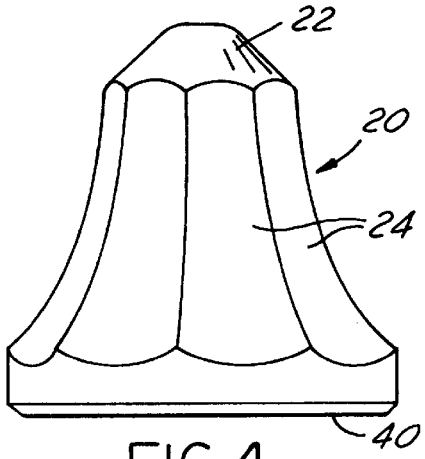
FIG. 4 is an enlarged side view of the tip of the bit of FIG. 1.
Figure 5:
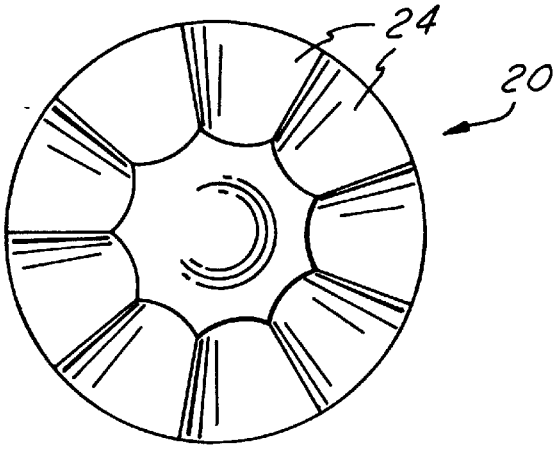
FIG. 5 is an enlarged end view of the tip of FIG. 4.

Referring in more detail to the drawings, FIG. 1 illustrates a point attack bit 10 with a shank 12 received in a counter bore 14 of a mounting block 16, a head 18 integral and coaxial with the shank 12 and a cutting tip 20 on the head. The tip 20 has a generally frustoconical end 22 and an odd number of side faces 24 formed between the end 22 and the base of the tip to rotate the bit 10 upon contacting the surface to be machined so that a different circumferential portion of the tip 20 engages the surface upon subsequent passes of the bit 10 on the surface to be machined. The rotation of the bit 10 within the mounting block 16 reduces the wear on the bit 10 and causes the bit 10 to wear more evenly to extend the life of the bit 10 and reduce the down time of the machine necessary to replace worn bits 10. Typically, these point attack bits 10 are used in mining operations and in various construction operations such as road planing asphalt or concrete roads and the like.

The mounting block 16 has a curved flange 30 which mounts on a power driven carrier wheel of a mining or construction machine. The block 16 could also be of the type that mounts on a traveling chain which carries a plurality of such blocks and associated mining bits 10. The bore 14 in the block opens at one end to receive the bit 10 and opens at its other end to a through bore 34 which permits insertion of a tool to remove the bit 10 from the block 16.

The shank 12 is preferably generally cylindrical with the head 18 projecting from one end of the shank 12. The head 18 is preferably frustoconical in shape having an enlarged base 36 and a generally tapered sidewall 38. The head 18 and shank 12 are preferably made of steel and may be formed by various processes, for example forging, cold heading, casting, etc. and machined as needed. The tip 20 is preferably a carbide insert operably connected to the head 18 and preferably permanently fixed to the head 18 such as by welding, brazing or otherwise attaching the tip 20 to the head 18.

The tip 20 has a base portion 40 which is preferably fixed to the head 18 and the end 22 which is preferably frustoconical or generally dome shaped. The frustoconical or dome shaped end 22 wears evenly and is not subject to being broken off as would be a sharply pointed end. The side faces 24 are formed between the base 40 and end 22 of the tip 20.

As shown in FIGS. 1–5, the faces 24 may be generally arcuate providing a generally frustoconical shaped tip 20. Desirably, at least five faces 24 and preferably nine faces 24 are provided. The odd number of faces 24 provide a tip 20 which, while symmetrical about the axis of rotation of the bit 10, does not have any pairs of opposed faces 24 which are parallel to each other. Thus, the tip 20 is unbalanced at all times with respect to a plane containing the path of travel of the bit 10. This unbalanced arrangement creates an uneven loading on the tip 20 as it engages the surface to be machined and causes the bit 10 to rotate. If the tip were formed with an even number of faces, each face would have an opposed parallel face providing a balanced bit which would not rotate effectively, if at all, in use.

Figure 8:
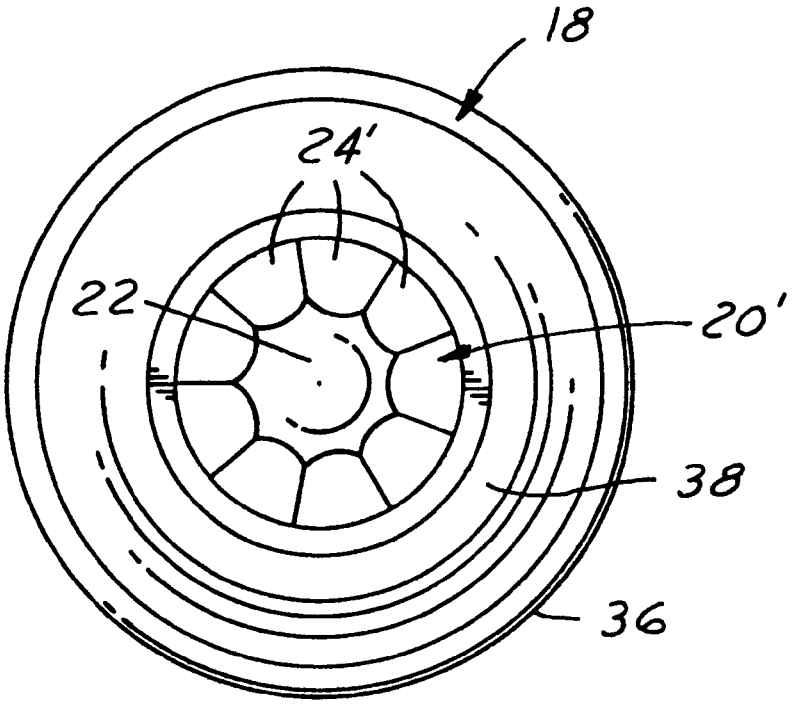
FIG. 8 is an end view of the bit of FIG. 1 with a modified tip.
Figure 9:
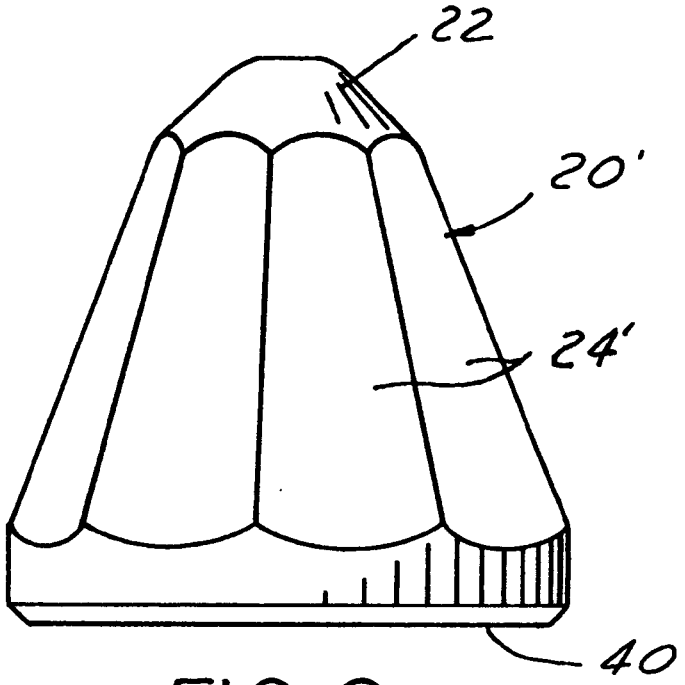
FIG. 9 is an enlarged side view of the modified tip of the bit of FIG. 8.

Alternatively, rather than the tip 20 having accurate side faces 24, as shown in FIGS. 8 and 9, each side face 24' may be generally flat providing a generally pyramid shaped tip 20'.

The bit 10 may be retained in the mounting block 16 by various methods such as that shown in FIG. 1 wherein a split ring sleeve 50 which has an at rest diameter larger than the bore 14 is used to retain the bit 10 within the mounting block 16. The sleeve 50 is received on a reduced diameter portion of the shank 12 and is retained between a chamfered enlarged portion 52 of the shank 12 adjacent the head 18 and a radially extending flange 54 adjacent the opposite end of the shank 12. Thus, the sleeve 50 is frictionally retained in the bore 14 to retain the bit 10 within the mounting block 16. The shank 12 is somewhat loosely held in the sleeve 50 to permit the bit 10 to rotate in use.

Figure 7:
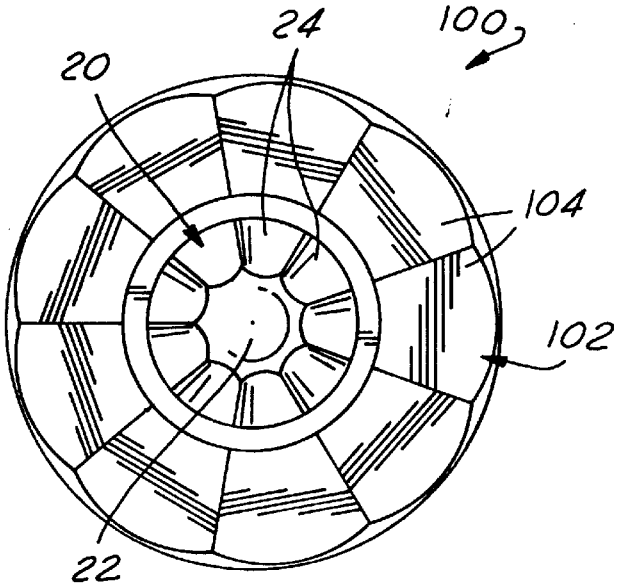
FIG. 7 is an enlarged end view of the bit of FIG. 6.
Figure 6:
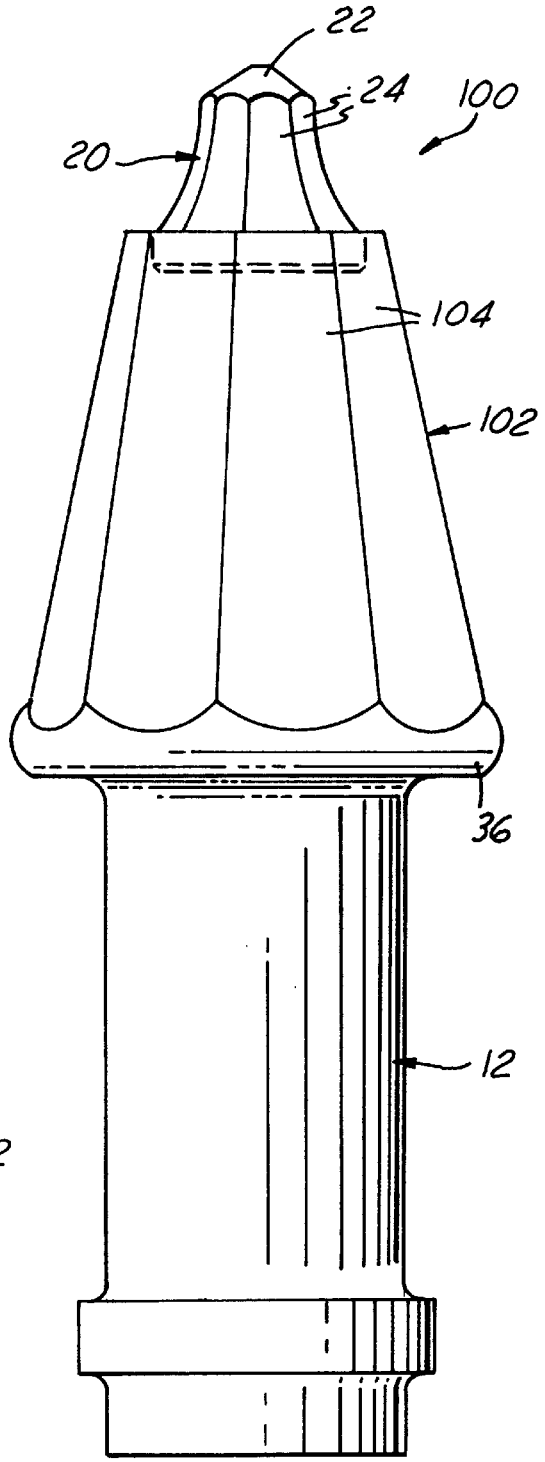
FIG. 6 is an enlarged side view of a bit according to a second embodiment of the invention.

As shown in FIGS. 6 and 7, in a second embodiment, a bit 100 according to the present invention has a head 102 with a plurality of side faces 104 formed therein, and preferably has the same odd number of side faces 104 as the tip 20 with each side face 104 of the head 102 preferably generally aligned with a corresponding side face 24 of the tip 20 as best seen in FIG. 7. This provides the head 102 with a geometry similar to the tip 20 wherein the head 102 does not have any pairs of opposed parallel faces 104 and is thus unbalanced at all times with respect to the plane containing the path of travel of the bit 100 so that upon contacting the surface to be machined, the bit 100 rotates. With the head 102 formed with the side faces 104, an increased rotation of the bit 100 occurs in use as compared to the first embodiment of the bit 10 to more evenly wear the bit 100 and to provide the self-sharpening action to extend the life of the bit 100 and thereby further reduce the down time of the machine. The bit 100 may be received in a similar mounting block 16 and functions in substantially the same manner as the bit 10 and hence, its operation and mounting will not be further described.

I claim:

1. A point attack bit adapted to be at least partially received in a bore of a tool holder to machine a surface comprising:

a shank adapted to be rotatably received in the bore of the tool holder;

a head integral and coaxial with the shank;

a cutting tip mounted on the head, constructed and arranged to engage a surface to be machined and having a solid body with a generally frustoconical end, as and a plurality and odd number of side faces on the body between the frustoconical end and the base, each side face having side edges, adjacent side edges of adjacent side faces being adjoined and the side faces collectively encircling the tip, whereby the bit rotates within the tool holder when the tip engages the surface to be machined.

2. The bit of claim 1 which has at least five side faces.

3. The bit of claim 1 wherein each side face is generally flat.

4. The bit of claim 1 wherein each side face is generally arcuate providing a generally frustoconical tip.

5. The bit of claim 2 which has nine side faces.

6. The bit of claim 1 wherein the head is generally frustoconical in shape.

7. The bit of claim 6 wherein the head has a plurality of side faces formed thereon.

8. The bit of claim 7 wherein the head and tip have the same number of side faces.

9. The bit of claim 8 wherein the side faces of the head are generally aligned with the side faces of the tip.

10. The bit of claim 6 wherein the head has a generally smooth exterior surface.

11. The bit of claim 1 wherein the tip is a seperated piece mounted on the head.

12. The bit of claim 1 wherein the tip is formed of tungsten carbide.

13. A point attack bit to machine a surface and constructed to be at least partially received in a bore of a tool holder comprising:

a shank constructed to be rotatably received in the bore of the tool holder;

a head integral and coaxial with the shank; and a tip constructed to engage a surface to be machined and having a solid body mounted on the head and having a base, a generally frustoconical end spaced from the base, the base being larger than the frustoconical end, a plurality and odd number of side faces extending from the frustoconical end to at least adjacent to the base, each side face having side edges with adjacent side edges of adjacent side faces being adjoined, and the side faces collectively encircling the tip, whereby the bit rotates within the holder when the tip machines the surface.

14. The bit of claim 13 which has at least five side faces and wherein the side faces collectively encircle the base.

15. The bit of claim 13 wherein the side faces are generally flat and collectively have a generally pyramidal configuration.

16. The bit of claim 13 wherein each side face is generally arcuate and the side faces collectively have a generally frustoconical configuration.

* * * * *

UNITED STATES PATENT AND TRADEMARK OFFICE

CERTIFICATE OF CORRECTION

PATENT NO. : 6,019,434

DATED : February 1, 2000

INVENTOR(S) : Kenneth C. Emmerich

It is certified that error appears in the above-indentified patent and that said Letters Patent is hereby corrected as shown below:

Col 4, Line 4, delete "as" and insert -- a base --.

Col 4, Line 27, delete "seperated" and insert -- separate --.

Signed and Sealed this

Twenty-seventh Day of February, 2001

Attest:

Nicholas P. Godici

NICHOLAS P. GODICI

Attesting Officer

Acting Director of the United States Patent and Trademark Office